US005967000A

United States Patent [19]

Davis

[11] Patent Number: 5,967,000

[45] Date of Patent: Oct. 19, 1999

[54] PLUG REMOVER FOR A BOTTLE

[76] Inventor: Leonard L. Davis, 1956 Shannon Drive, Mississauga, Ontario, Canada, L5H 3W2

[21] Appl. No.: 09/026,948

[22] Filed: Feb. 20, 1998

[51] Int. Cl.[6] ..... B67B 7/14

[52] U.S. Cl. ..... 81/3.4; 81/3.29; 81/3.07

[58] Field of Search ..... 81/3.07, 3.36, 81/3.29, 3.4; 7/151

[56] References Cited

U.S. PATENT DOCUMENTS

| | | | |
|---|---|---|---|
| 1,081,302 | 12/1913 | Geddis | 81/3.4 |
| 1,647,892 | 11/1927 | Viebrock | 81/3.4 |
| 1,954,422 | 4/1934 | McIntyre | 81/3.4 |
| 2,246,649 | 6/1941 | West | 81/3.4 |
| 2,761,338 | 9/1956 | Hardy | 81/3.29 |
| 3,919,901 | 11/1975 | Braman | 81/3.4 |
| 4,067,279 | 1/1978 | Lester et al. | 81/3.4 |
| 4,442,735 | 4/1984 | Chance et al. | 81/3.36 |
| 4,704,924 | 11/1987 | Echols | 7/151 |
| 4,770,069 | 9/1988 | Mikan et al. | 81/3.07 |

*Primary Examiner*—David A. Scherbel
*Assistant Examiner*—Joni B. Danganan
*Attorney, Agent, or Firm*—Dimock Stratton Clarizio

[57] ABSTRACT

A plug remover for extracting a plug from a marker bottle or the like slips laterally over and entraps the plug. The plug remover includes a handle making it easy to grasp, which in the preferred embodiment has a flat top surface and can be inverted and placed on a table top or other surface, with the plug still in the plug remover, while the bottle is refilled. In the preferred embodiment the plug remover includes a bottom cam which, after the plug has been entrapped by the remover, can be turned along the thread of the bottle neck and rides up the thread to provide additional leverage for overcoming the "stiction" between the plug and the neck of the bottle.

18 Claims, 3 Drawing Sheets

PLUG REMOVER FOR A BOTTLE

FIELD OF INVENTION

This invention relates to bottles. In particular, this invention relates to a plug remover for a marker bottle or the like.

BACKGROUND OF THE INVENTION

Marker bottles, which are ink-filled bottles having a plug with a foam or fabric pad, are popular in bingo halls. The game of bingo involves a game card consisting of an array of numbers, usually from 1 to 75, which are called in random order by the bingo hall operator. Each called number appearing on a player's card is marked off by the player. A marker bottle is a convenient way of marking off numbers called during a game of bingo.

A marker bottle typically comprises a plastic container having a threaded neck and a plug which slip-fits into the neck. The plug includes a top opening covered by or filled with a liquid-permeable pad made from foam, fabric or another permeable material, which allows ink or dye contained in the bottle to be dabbed onto a substrate such as a bingo card. The permeable material controls the flow of ink or dye from the bottle. A threaded closure is typically provided for storing the marker bottle when not in use, to prevent spillage and keep the ink or dye from drying out.

A significant problem is presented by the need to refill the bottle from time to time. The user must grasp the plug and extract it from the neck in order to open the bottle for refilling. However, the plug fits into the neck very snugly to prevent seepage, and the collar of the plug is typically not much wider than the neck of the bottle leaving very little surface for the user to grasp, thus rendering removal of the plug quite difficult. This problem is exacerbated by wet ink or dye from the bottle, which during use seeps onto the plug and makes the plug collar quite slippery and difficult to grasp. Further, ink or dye can creep between the plug and the neck of the bottle, which when dried over time increases the static friction or "stiction" between the plug and the neck and renders removal of the plug even more difficult.

SUMMARY OF THE INVENTION

The present invention overcomes these disadvantages by providing a plug remover which slips over and entraps the plug of a bottle such as a marker bottle or the like. The plug remover includes a handle making it easy to grasp, and thus facilitates extracting the plug from the bottle.

In the preferred embodiment the handle has a flat top surface and can thus be inverted and placed on a table top or other surface, with the plug still in the plug remover, while the bottle is refilled. The plug remains in the plug remover while the plug is replaced into the neck of the bottle, thereby avoiding potential staining of hands which can occur when the plug is removed and replaced manually.

Also, in the preferred embodiment the plug remover includes a bottom cam. After the plug has been entrapped the plug remover can be turned so a that the cam rides along the rising thread of the bottle to provide additional leverage for overcoming the "stiction" between the plug and the neck of the bottle.

The present invention thus provides a plug remover comprising a handle, and a plug entrapping portion comprising an upper rib and a lower rib forming a channel therebetween, and an opening extending from a lower edge of the lower rib to the upper rib, wherein the plug entrapping portion can be engaged over the plug of a bottle by passing the plug through the opening, a collar of the plug being thereby releasably entrapped in the plug entrapping portion so that the plug can be extracted from the bottle by drawing the plug remover away from the bottle.

The present invention further provides a plug remover for removing a plug from a bottle comprising a neck into which a spigot of the plug fits in a slip-fit engagement, the spigot depending from a collar having a diameter larger than a diameter of the spigot, the plug remover comprising a handle, and a plug entrapping portion for engagement over the collar, comprising an upper rib and a lower rib forming a channel therebetween approximating a thickness of the collar, and an opening extending from a lower edge of the lower rib to the upper rib, wherein the plug entrapping portion can be engaged over the collar of the plug by passing the plug through the opening, and the plug can thereby be extracted from the bottle by drawing the plug remover away from the bottle.

BRIEF DESCRIPTION OF THE DRAWINGS

In drawings which illustrate by way of example only a preferred embodiment of the invention.

DETAILED DESCRIPTION OF THE INVENTION

Figure 3:
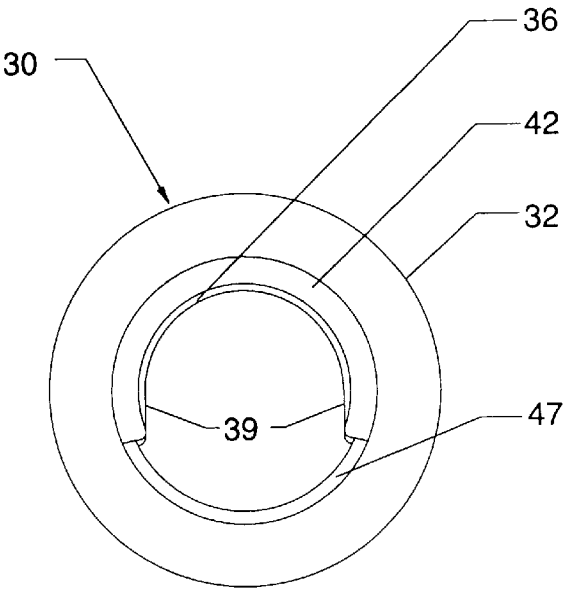
FIG. 3 is a bottom plan view of the plug remover.

A typical marker bottle 10 is illustrated in FIGS. 5*a* to 5*d*. The marker bottle 10 comprises a liquid-impervious plastic container 12, having a neck 14 with a top opening circumscribed by a lip 18 (seen in FIG. 5*d*) and a thread 16 disposed about the outer wall of the neck 14, usually at a pitch of approximately 5°, for engaging a conventional threaded closure (not shown) which is used to seal the bottle 10 when not in use.

The marker bottle 10 further comprises a plug 20 having a spigot 22, which generally tapers slightly toward its lower end to facilitate insertion into the neck 14 of the container 12 and fits snugly within the neck 14. The spigot 22 depends from a collar 24 which is slightly wider than the neck 14 and which rests against the lip 18 when the plug 20 is fully inserted into the neck 14. The spigot 22 is hollow and in communication with an opening in the collar 24 covered by a permeable pad 26, usually made of foam, cloth or some other porous material. The spigot 22 fits snugly within the neck 14, so that when the bottle 10 is inverted a controlled flow of ink, dye or other contents of the container 12 is achieved by dabbing the pad 26 onto the substrate or other article to be coloured.

Figures 5A, 5B, 5C, 5D:
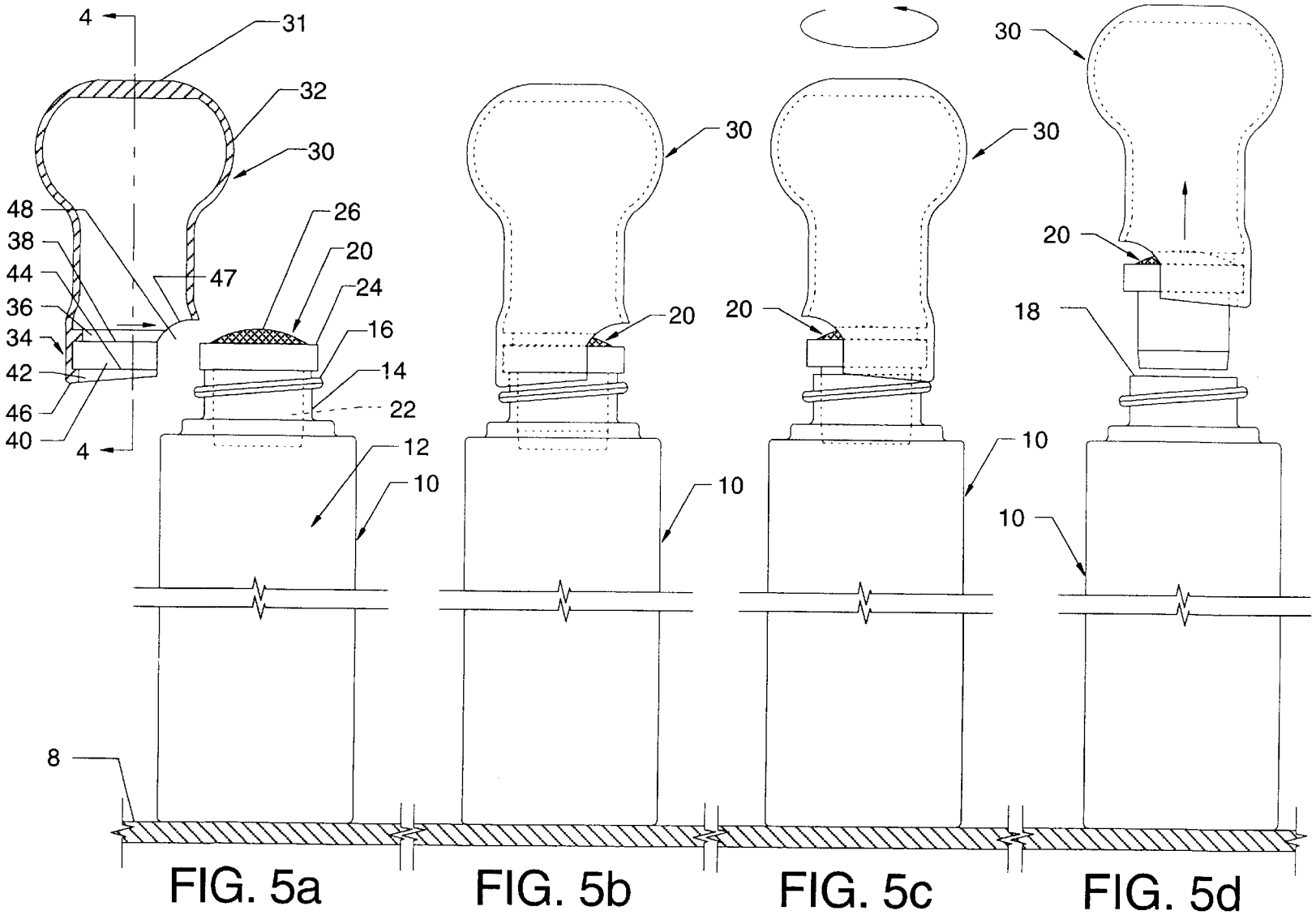
FIG. 5*a* is an elevation partly in cross-section showing the plug remover in position for entrapping the plug.
FIG. 5*b* is an elevation showing the plug entrapped in the plug remover.
FIG. 5*c* is an elevation showing the plug remover rotated for partial extraction of the plug.
FIG. 5*d* is an elevation showing the plug fully extracted.

To refill the bottle 10, the plug 20 must be removed in order to expose the top opening in the neck 14. As can be seen in FIG. 5*a*, the collar 24 barely extends beyond the periphery of the neck 14, leaving a very small ledge beneath the collar 24 for the user to grasp, and about much of the circumference of the neck 14 the thread 16 is very close to the collar 24 and thus interferes with attempts to grasp the collar 24. This renders the plug 20 difficult to extract from the container 12, especially where dried ink or dye has crusted about the spigot 22.

FIGS. 1 to 4 illustrate a preferred embodiment of the plug remover 30 of the invention by way of example. The plug remover 30 comprises a handle 32 and a generally cylindrical plug entrapping portion 34, preferably moulded as an integral unit from a suitably strong, preferably resilient plastic. In the embodiment shown the handle 32 is configured as a bulb, dimensioned to facilitate grasping by the user, however the handle 32 may be formed to any convenient shape and the invention is not intended to be limited by the shape of the handle 32. If desired indicia such as promotional text or designs may be applied to the handle 32.

The entrapping portion 34 comprises an upper rib 36 spaced from a lower rib 42 forming a channel 40 approximating the thickness of the collar 24 therebetween, and an opening 48 which extends upwardly through the entrapping portion 34, preferably from the bottom of the lower rib 42 to slightly above the upper rib 36. The width of the opening 48 is preferably slightly smaller than the diameter of the collar 24, for reasons described below. In the embodiment shown the upper edge 47 of the opening 48 is convexly curvate to accommodate the projecting portion of the pad 26.

The ribs 36, 42 are preferably spaced apart a distance approximating the thickness of the collar 24, and the engaging surfaces of the entrapping portion 34, ie. the lower edge 38 of the upper rib 36 and the upper edge 44 of the lower rib 42, are preferably substantially parallel.

Figure 2:
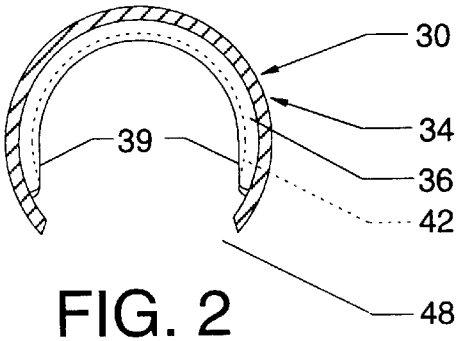
FIG. 2 is a cross-section taken along the line 2—2 in FIG. 1.
Figure 1:
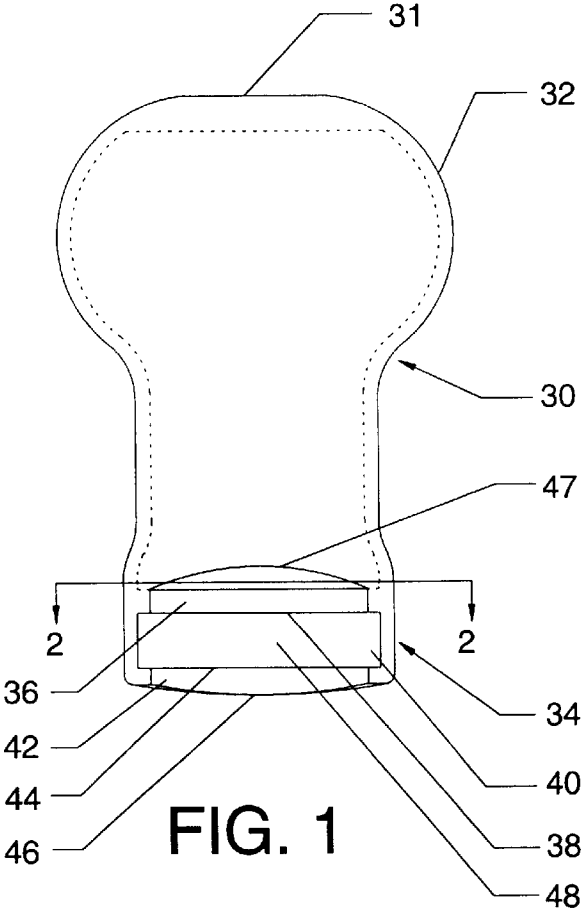
FIG. 1 is a front elevation of a preferred embodiment of the plug remover of the invention.
Figure 6:
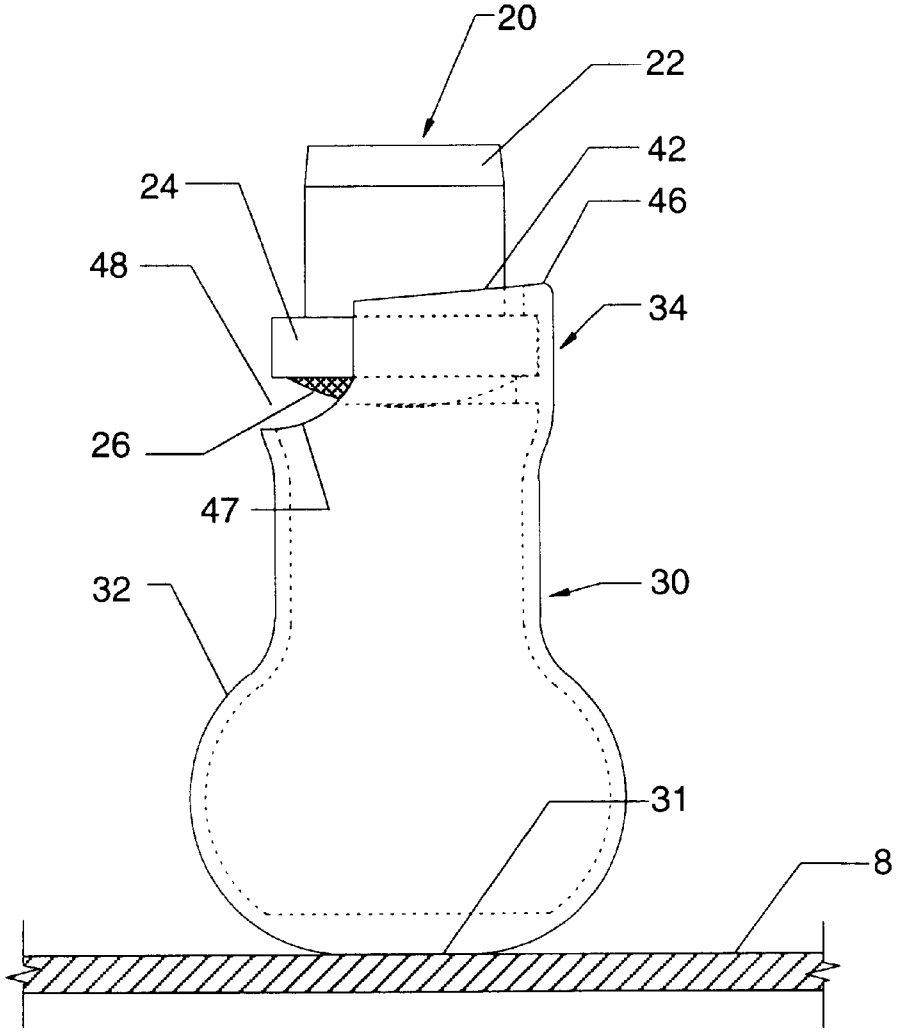
FIG. 6 is an elevation showing the plug remover in an inverted self-standing position.
Figure 4:
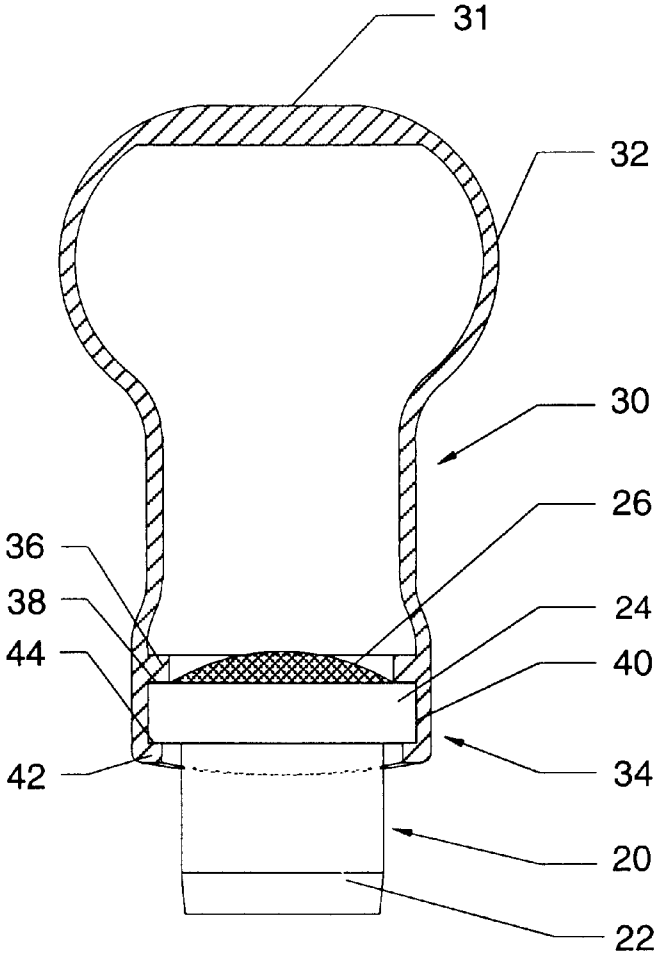
FIG. 4 is a front elevational cross-section of the plug remover.

The ribs 36, 42 are preferably formed as deep as possible, to maximize engagement of the plug 20 by the entrapping portion 34. When the plug 20 is entrapped the lower rib 42 surrounds the neck 14 of the container 12 while the upper rib 36 surrounds the pad 26. The inside diameter of the lower rib 42 is thus limited by the outside diameter of the neck 14, while the inside diameter of the upper rib 36 is limited by the diameter of the pad 26. Thus, as shown in FIGS. 2 and 3, the upper rib 36 can be made to protrude further than the lower rib 42 around most of the circumference of the entrapping portion 34. However, to avoid crushing or marring the pad 26 the depth of the upper rib 36 should taper slightly toward the opening 48, as along flattened surfaces 39 (best seen in FIGS. 2 and 3).

In the preferred embodiment the bottom of the plug remover 30 is provided with a cam 46, which in the embodiment illustrated is shown as a sloped bottom edge of the plug remover 30, ie. the lower rib 42 gradually increases thickness toward the rear of the entrapping portion 34 (shown at the left in FIG. 5*a*). In this embodiment the cam 46 preferably has a slope approximating the pitch of the thread 16 on the neck 14 of the container 12. The cam 46 may alternatively comprise a boss or projection located along any convenient portion of the underside of the lower rib 42, however gradually tapering the thickness of the lower rib 42 as shown may render it easier for a user to orient the plug remover 30 for engagement over the plug 20 according to the pitch of the thread 16, for reasons described below.

In operation, the threaded closure (not shown) is removed from the bottle 10. The plug remover 30 is oriented relative to the container 12 so that the cam 46 coincides with a lower portion of the thread 16. In the embodiment shown, the pitch of the cam 46 is oriented to match the pitch of the thread 16, as shown in FIG. 5*a*. The plug remover 30 is forced laterally in the direction of the arrow in FIG. 5*a*, so that the entrapping portion 34 engages over the collar 24 of the plug 20 with the upper rib 36 engaging over the top of the collar 24 and the lower rib 42 engaging about the upper portion of the neck 14 of the container 12, as shown in FIG. 5*b*.

In the preferred embodiment the width of the opening 48 is smaller than the diameter of the collar 24 (and thus smaller than the inside diameter of the entrapping portion 34) so that the entrapping portion 34 will engage more than one half of the collar 24. As the plug remover 30 is engaged over the plug 20 the side edges of the opening 48 will splay apart when the opening 48 passes the diameter of the collar 20, and as the plug 20 is fully entrapped the resilient wall of the entrapping portion 34 causes the side edges of the opening 48 to grasp the collar 24. This improves the engagement of the plug 20 within the entrapping portion 34. The upper edge 47 of the opening 48 is raised sufficiently to allow the pad 26 to pass through the opening 48 without being scraped or marred.

At this point the user may simply grasp the handle 32 and the container 12, and draw the plug remover 30 away from the container 12 to extract the plug 20. However, where the plug 20 is firmly engaged into the neck 14, and perhaps adhered to the neck 14 by dried ink or dye, to overcome the "stiction" between the plug 20 and the neck 14 the user can hold the entrapping portion 34 snugly against the neck 14 of the container 12 and rotate the plug remover 30 in the upwardly rising direction of the thread 16 (counterclockwise in the embodiment shown). When the plug remover 30 is rotated the cam 46 will ride along the rising thread 16, raising the plug remover 30 and thereby partially extracting the plug 20, as shown in FIG. 5*c*. The plug 20 can then be more readily fully extracted, as shown in FIG. 5*d*, by drawing the plug remover 30 away from the container 12.

In the preferred embodiment the plug remover 30 has a flat top surface 31, allowing the user to place the plug remover 30, with the plug 20 still entrapped therein, inverted on a table 8 or other convenient surface. The plug remover 30 stands inverted on the surface 31 while the user refills the container 12. Once refilling is complete, the user picks up the plug remover 30, aligns the spigot 22 of the plug 20 with the opening in the neck 14 of the container 12 (and aligns the pitch of the cam 46 to match the pitch of the thread 16), and inserts the plug 20 into the neck 14. After the plug 20 has been inserted the user slides the plug remover 30 laterally off of the plug 20, and the bottle 10 is ready for use. Throughout this procedure the user's hand need never touch the plug 20, thus avoiding the possibility of staining.

A preferred embodiment of the invention having been thus described by way of example only, it will be apparent to those skilled in the art that certain modifications and adaptations may be made without departing from the scope of the invention, as set out in the appended claims.

I claim:

1. A plug remover comprising a handle, a plug entrapping portion formed from a resilient material comprising an upper rib and a lower rib forming a channel therebetween, and a lateral opening extending from a lower edge of the lower rib to the upper rib, the opening being smaller than a diameter of the collar so that the entapping portion engages more than one half of the collar, wherein the plug entrapping portion can be engaged over the plug of a bottle by passing the plug through the lateral opening, a collar of the plug being thereby releasably entrapped in the channel so that the plug can be extracted from the bottle by drawing the plug remover away from the bottle.

2. The plug remover of claim 1 in which the lower rib is provided with a bottom cam which when the plug remover is engaged to the plug and rotated rides along a rising thread provided about the neck of the bottle to partially extract the plug from the bottle.

3. The plug remover of claim 2 in which the cam is formed by a sloped bottom edge of the plug remover.

4. The plug remover of claim 2 in which the slope of the bottom edge approximates a pitch of the thread.

5. The plug remover of claim 1 in which the handle and the entrapping portion are formed as an integral unit.

6. The plug remover of claim 5 in which the plug remover is moulded from plastic.

7. The plug remover of claim 1 in which an upper surface of the lower rib is substantially parallel to a lower surface of the upper rib.

8. The plug remover of claim 1 in which the upper rib protrudes further than the lower rib and includes tapered end portions which allow a pad projecting from a top of the plug to pass freely into the entrapping portion.

9. The plug remover of claim 1 in which the opening has a curvate upper edge.

10. A plug remover for removing a plug from a bottle comprising a neck into which a spigot of the plug fits in a slip-fit engagement, the spigot depending from a collar having a diameter larger than a diameter of the spigot, the plug remover comprising a handle, a plug entrapping portion formed from a resilient material for engagement over the collar, comprising an upper rib and a lower rib forming a channel therebetween approximating a thickness of the collar, and a lateral opening extending from a lower edge of the lower rib to the upper rib, the opening being smaller than a diameter of the collar so that the entrapping portion engages more than one half of the collar, wherein the plug entrapping portion can be engaged over the collar of the plug by passing the plug through the lateral opening, and the plug can thereby be extacted from the bottle by drawing the plug remover away from the bottle.

11. The plug remover of claim 10 in which the lower rib is provided with a bottom cam which when the plug remover is engaged to the plug and rotated rides along a rising thread provided about the neck of the bottle to partially extract the plug from the bottle.

12. The plug remover of claim 11 in which the cam is formed by a sloped bottom edge of the plug remover.

13. The plug remover of claim 11 in which the slope of the bottom edge approximates a pitch of the thread.

14. The plug remover of claim 10 in which the handle and the entrapping portion are formed as an integral unit.

15. The plug remover of claim 14 in which the plug remover is moulded from plastic.

16. The plug remover of claim 10 in which an upper surface of the lower rib is substantially parallel to a lower surface of the upper rib.

17. The plug remover of claim 10 in which the upper rib protrudes further than the lower rib and includes tapered end portions which allow a pad projecting from a top of the plug to pass freely into the entrapping portion.

18. The plug remover of claim 10 in which the opening has a curvate upper edge to accommodate a projecting portion of a pad projecting from the plug.

* * * * *